US012139900B2

(12) United States Patent
Brown et al.

(10) Patent No.: US 12,139,900 B2
(45) **Date of Patent: *Nov. 12, 2024**

(54) URINAL SCREENS

(71) Applicant: Fresh Products, Inc., Perrysburg, OH (US)

(72) Inventors: Douglas S. Brown, Toledo, OH (US); Jeffrey A. Smith, Perrysburg, OH (US)

(73) Assignee: Fresh Products, Inc., Perrysburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/667,781

(22) Filed: May 17, 2024

(65) Prior Publication Data

US 2024/0301674 A1 Sep. 12, 2024

Related U.S. Application Data

(63) Continuation of application No. 18/460,438, filed on Sep. 1, 2023, which is a continuation of application No. 17/809,671, filed on Jun. 29, 2022, now Pat. No. 11,781,305, which is a continuation of application No. 17/643,791, filed on Dec. 10, 2021, now Pat. No. 11,396,745, which is a continuation of application No. 16/666,802, filed on Oct. 29, 2019, now Pat. No. 11,198,997, which is a continuation of application (Continued)

(51) Int. Cl.
*E03D 13/00* (2006.01)
*E03D 9/00* (2006.01)

(52) U.S. Cl.
CPC ..... *E03D 13/005* (2013.01); *E03D 9/00* (2013.01); *E03D 9/007* (2013.01)

(58) Field of Classification Search
CPC ..... E03D 9/005; E03D 9/007; E03D 9/00; E03D 13/005
See application file for complete search history.

(56) References Cited

U.S. PATENT DOCUMENTS 333,935 A 1/1886 Duncan
487,130 A 11/1892 Schoen
(Continued)

FOREIGN PATENT DOCUMENTS

CN 3680203 D 8/2007
CN 201649256 U 11/2010
(Continued)

OTHER PUBLICATIONS

Plaintiff Fresh Products, Inc., Complaint for Patent Infringement Demand for Jury Trial, Case No. 2:19-cv-05994, filed Jul. 11, 2019.
(Continued)

*Primary Examiner* — Janie M Loeppke
(74) *Attorney, Agent, or Firm* — KNOBBE, MARTENS, OLSON & BEAR, LLP

(57) ABSTRACT

A urinal screen having a frame and a plurality of protrusions extending from the frame. The frame can include a plurality of openings. The openings can be defined by a plurality of perimeter structures. The protrusions can extend from the perimeter structures. In some embodiments, protrusions extend from a first face and a second face of the frame.

15 Claims, 6 Drawing Sheets

Related U.S. Application Data

No. 16/175,379, filed on Oct. 30, 2018, now Pat. No. 10,501,924, which is a continuation of application No. 14/925,369, filed on Oct. 28, 2015, now Pat. No. 10,145,098.

(60) Provisional application No. 62/075,827, filed on Nov. 5, 2014.

(56) References Cited

U.S. PATENT DOCUMENTS

| | | | |
|---|---|---|---|
| 539,698 | A | 5/1895 | Milligan |
| 555,888 | A | 3/1896 | Roberts |
| 557,762 | A | 4/1896 | Brockman |
| 571,275 | A | 11/1896 | Maxwell et al. |
| 675,947 | A | 6/1901 | Hack |
| 810,973 | A | 1/1906 | Pattenden et al. |
| 927,026 | A | 7/1909 | Clayton |
| 950,574 | A | 3/1910 | Morgan |
| 1,109,904 | A | 9/1914 | Dahlgren |
| 1,186,345 | A | 6/1916 | Sleight |
| 1,208,675 | A | 12/1916 | Sleight |
| 1,260,082 | A | 3/1918 | Sleight |
| 1,292,856 | A | 1/1919 | Niblo |
| 1,731,431 | A | 10/1929 | Meyer |
| 1,880,962 | A | 10/1932 | Koppelman |
| 1,886,676 | A | 11/1932 | Heuacker |
| 1,935,128 | A | 11/1933 | Pullman |
| 2,011,732 | A | 8/1935 | Saeks |
| 2,020,864 | A | 11/1935 | Aronson et al. |
| 2,087,592 | A | 7/1937 | Chesnut |
| 2,211,970 | A | 8/1940 | Fischer |
| 2,233,234 | A | 2/1941 | Wilson |
| 2,447,178 | A | 8/1948 | Hatchette |
| 2,506,669 | A | 5/1950 | Heuacker |
| 2,508,808 | A | 5/1950 | Warman |
| 2,679,054 | A | 5/1954 | Singleton |
| 2,690,569 | A | 10/1954 | Kozerski |
| 2,931,047 | A | 4/1960 | Stebbins |
| 2,984,841 | A | 5/1961 | Wilson |
| 3,005,209 | A | 10/1961 | Timmons |
| D194,776 | S | 3/1963 | Clark |
| D194,777 | S | 3/1963 | Clark |
| 3,170,169 | A | 2/1965 | Clark |
| 3,237,330 | A | 3/1966 | Dinstbir |
| 3,248,740 | A | 5/1966 | Wisnom |
| 3,268,920 | A | 8/1966 | Beer |
| 3,329,998 | A | 7/1967 | Stohr |
| 3,387,069 | A | 6/1968 | Stohr |
| 3,422,558 | A | 1/1969 | Fee |
| 3,540,433 | A | 11/1970 | Brockman |
| 3,597,772 | A | 8/1971 | Leavitt et al. |
| 3,614,790 | A | 10/1971 | Billingsly et al. |
| 3,631,560 | A | 1/1972 | Atkins |
| 3,723,998 | A | 4/1973 | Wehr |
| 3,752,121 | A | 8/1973 | Brazzell |
| 3,760,429 | A | 9/1973 | Brownstein |
| 3,788,485 | A | 1/1974 | Bruning |
| 3,804,796 | A | 4/1974 | Alexandre |
| 3,824,633 | A | 7/1974 | Van Vlahakis |
| 3,837,988 | A | 9/1974 | Hennen et al. |
| 3,867,953 | A | 2/1975 | Stohr |
| 3,899,192 | A | 8/1975 | Reddaway |
| 3,923,442 | A | 12/1975 | Stohr |
| 3,935,602 | A | 2/1976 | Kale |
| 4,010,497 | A | 3/1977 | Menter et al. |
| 4,095,031 | A | 6/1978 | Engle |
| 4,103,367 | A | 8/1978 | Kaufer |
| D253,145 | S | 10/1979 | Adam |
| D255,744 | S | 7/1980 | Dekko |
| 4,212,153 | A | 7/1980 | Kydonieus et al. |
| 4,215,443 | A | 8/1980 | Babik |
| 4,230,582 | A | 10/1980 | Tuleja |
| D258,181 | S | 2/1981 | Adam |
| D258,472 | S | 3/1981 | Adam |
| 4,305,216 | A | 12/1981 | Skelton |
| 4,361,606 | A | 11/1982 | Butler et al. |
| 4,389,963 | A | 6/1983 | Pearson |
| 4,405,509 | A | 9/1983 | Rogers et al. |
| 4,408,557 | A | 10/1983 | Bradley et al. |
| 4,418,432 | A | 12/1983 | Vidal |
| 4,440,542 | A | 4/1984 | Foley |
| 4,490,862 | A | 1/1985 | Vidal |
| 4,515,909 | A | 5/1985 | Sawano et al. |
| D280,267 | S | 8/1985 | Bryant et al. |
| 4,549,693 | A | 10/1985 | Barlics |
| 4,552,693 | A | 11/1985 | Hussain et al. |
| 4,557,863 | A | 12/1985 | Callewaert et al. |
| 4,574,400 | A | 3/1986 | Annowsky |
| 4,574,403 | A | 3/1986 | Dintemann et al. |
| 4,604,357 | A | 8/1986 | Callewaert et al. |
| 4,612,676 | A | 9/1986 | Whitman |
| 4,671,976 | A | 6/1987 | Vidal |
| 4,750,219 | A | 6/1988 | Williams |
| 4,761,437 | A | 8/1988 | Christie |
| 4,815,767 | A | 3/1989 | Lambert |
| 4,830,407 | A | 5/1989 | Sadler, Jr. et al. |
| 4,866,793 | A | 9/1989 | Luedtke et al. |
| 4,941,688 | A | 7/1990 | Jones |
| D312,740 | S | 12/1990 | Greenhut et al. |
| 4,985,940 | A | 1/1991 | Jones |
| 5,010,599 | A | 4/1991 | Nilsson |
| 5,019,434 | A | 5/1991 | Matsumoto |
| 5,058,088 | A | 10/1991 | Haas et al. |
| 5,058,523 | A | 10/1991 | Mikkonen et al. |
| 5,087,273 | A | 2/1992 | Ward |
| 5,117,515 | A | 6/1992 | White, Jr. et al. |
| 5,130,016 | A | 7/1992 | Gavin |
| 5,139,864 | A | 8/1992 | Lindauer |
| D329,893 | S | 9/1992 | Luedtke et al. |
| 5,150,481 | A | 9/1992 | Pang |
| 5,150,722 | A | 9/1992 | Rutherford |
| 5,165,119 | A | 11/1992 | Yamato |
| 5,188,755 | A | 2/1993 | Chang |
| D341,414 | S | 11/1993 | Baker |
| 5,309,578 | A | 5/1994 | Temple, Sr. |
| 5,313,672 | A | 5/1994 | Luedtke et al. |
| 5,336,424 | A | 8/1994 | Vlahakis et al. |
| 5,364,132 | A | 11/1994 | Haas et al. |
| 5,365,616 | A | 11/1994 | Morad |
| 5,377,362 | A | 1/1995 | Jackson |
| D355,807 | S | 2/1995 | O'Rourke |
| 5,398,347 | A | 3/1995 | Luedtke et al. |
| D360,714 | S | 7/1995 | d'Alquen |
| 5,472,712 | A | 12/1995 | Oshlack et al. |
| 5,479,735 | A | 1/1996 | Martin, Jr. |
| 5,482,007 | A | 1/1996 | Kumlin |
| 5,489,415 | A | 2/1996 | Van Vlahakis et al. |
| 5,496,300 | A | 3/1996 | Hirsch et al. |
| D370,938 | S | 6/1996 | Roach |
| 5,556,685 | A | 9/1996 | Swicegood, Jr. |
| 5,580,578 | A | 12/1996 | Oshlack et al. |
| 5,604,937 | A | 2/1997 | Davenport |
| 5,639,476 | A | 6/1997 | Oshlack et al. |
| 5,660,138 | A | 8/1997 | Hirsch |
| 5,719,828 | A | 2/1998 | Haas et al. |
| D393,896 | S | 4/1998 | Wagner et al. |
| 5,774,905 | A | 7/1998 | Wager et al. |
| 5,809,590 | A | 9/1998 | Williams et al. |
| 5,813,058 | A | 9/1998 | Quigley et al. |
| 5,867,848 | A | 2/1999 | Ort |
| 5,885,701 | A | 3/1999 | Berman et al. |
| 5,958,334 | A | 9/1999 | Haddon |
| 5,961,148 | A | 10/1999 | Cheng |
| D422,061 | S | 3/2000 | Lee |
| 6,055,681 | A | 5/2000 | Lyons |
| D427,295 | S | 6/2000 | Wagner |
| 6,076,222 | A | 6/2000 | Jolly |
| 6,079,975 | A | 6/2000 | Conover |
| 6,081,937 | A | 7/2000 | Whitacre |
| 6,103,201 | A | 8/2000 | Green |
| 6,103,351 | A | 8/2000 | Ram et al. |
| 6,113,148 | A | 9/2000 | Koranda et al. |
| D438,710 | S | 3/2001 | Chen |

(56) References Cited

U.S. PATENT DOCUMENTS

| | | | |
|---|---|---|---|
| 6,207,236 | B1 | 3/2001 | Araki et al. |
| 6,213,409 | B1 | 4/2001 | Warren et al. |
| D442,246 | S | 5/2001 | McCabe et al. |
| 6,244,208 | B1 | 6/2001 | Qui et al. |
| 6,257,540 | B1 | 7/2001 | Kresch |
| 6,265,084 | B1 | 7/2001 | Stickler |
| 6,269,490 | B1 | 8/2001 | Suski et al. |
| 6,279,759 | B1 | 8/2001 | Weisbach |
| D456,492 | S | 4/2002 | Lourens |
| 6,370,705 | B1 | 4/2002 | Levinson |
| D464,122 | S | 10/2002 | Mangan |
| 6,517,759 | B1 | 2/2003 | Ferenc et al. |
| 6,640,350 | B1 | 11/2003 | Deutsch |
| 6,698,035 | B1 | 3/2004 | Grueser |
| 6,703,012 | B1 | 3/2004 | White |
| 6,730,311 | B2 | 5/2004 | Maleeny et al. |
| 6,787,210 | B2 | 9/2004 | Stickler |
| D497,277 | S | 10/2004 | Ruhl et al. |
| 6,823,533 | B2 | 11/2004 | Casari |
| 6,862,754 | B1 | 3/2005 | DeMarco |
| 6,920,648 | B1 | 7/2005 | Suski et al. |
| 6,927,199 | B2 | 8/2005 | Takemura et al. |
| 6,988,462 | B1 | 1/2006 | Zhu |
| D520,610 | S | 5/2006 | Wrate |
| 7,061,831 | B2 | 6/2006 | De La Huerga |
| D528,193 | S | 9/2006 | Lee |
| 7,127,844 | B2 | 10/2006 | Collins |
| 7,202,201 | B1 | 4/2007 | Williams |
| D561,327 | S | 2/2008 | Dejonge |
| 7,398,565 | B1 | 7/2008 | Chou |
| 7,413,082 | B2 | 8/2008 | Adler et al. |
| 7,419,588 | B2 | 9/2008 | Lawson |
| 7,434,535 | B2 | 10/2008 | Adamy |
| 7,528,102 | B2 | 5/2009 | Barthel et al. |
| D598,075 | S | 8/2009 | Uhl |
| 7,597,949 | B2 | 10/2009 | Wright |
| D612,914 | S | 3/2010 | Morad |
| 7,742,367 | B2 | 6/2010 | Haas |
| 7,808,861 | B2 | 10/2010 | Wien |
| 7,833,515 | B2 | 11/2010 | Corzani et al. |
| D630,714 | S | 1/2011 | Dukes |
| 7,904,972 | B2 | 3/2011 | Anderson |
| 7,921,479 | B2 | 4/2011 | Hunter |
| 7,921,583 | B2 | 4/2011 | Londino |
| D639,410 | S | 6/2011 | Ramirez |
| 8,007,707 | B1 | 8/2011 | Brown |
| 8,043,498 | B2 | 10/2011 | Rueda |
| D678,482 | S | 3/2013 | Williams |
| D678,483 | S | 3/2013 | Barker |
| D682,398 | S | 5/2013 | Lee |
| D687,524 | S | 8/2013 | Heiser |
| D687,525 | S | 8/2013 | Heiser |
| D703,409 | S | 4/2014 | Robbins, III et al. |
| 8,856,977 | B2 | 10/2014 | Ramirez |
| 9,243,394 | B2 | 1/2016 | Brown et al. |
| 9,303,396 | B1 | 4/2016 | Pernici |
| 9,334,641 | B2 | 5/2016 | Kobal |
| D778,411 | S | 2/2017 | Brown et al. |
| D778,412 | S | 2/2017 | Brown et al. |
| D778,423 | S | 2/2017 | Buzanowski et al. |
| D790,042 | S | 6/2017 | Ramirez |
| D805,613 | S | 12/2017 | D'Amico et al. |
| D806,835 | S | 1/2018 | D'Amico et al. |
| D806,836 | S | 1/2018 | D'Amico et al. |
| D806,837 | S | 1/2018 | D'Amico et al. |
| D824,495 | S | 7/2018 | D'Amico et al. |
| D824,496 | S | 7/2018 | D'Amico et al. |
| 10,036,154 | B2 | 7/2018 | Crevier |
| 10,087,612 | B2 | 10/2018 | Brown et al. |
| 10,145,098 | B2 | 12/2018 | Brown et al. |
| D838,818 | S | 1/2019 | Malesky et al. |
| D841,359 | S | 2/2019 | Crevier |
| 10,267,027 | B2 | 4/2019 | D'Amico et al. |
| D857,181 | S | 8/2019 | Brown |
| 10,501,924 | B2 | 12/2019 | Brown et al. |
| D875,896 | S | 2/2020 | Dukes et al. |
| 10,612,226 | B2 | 4/2020 | Hurd et al. |
| 10,640,959 | B2 | 5/2020 | Malesky et al. |
| D920,485 | S | 5/2021 | Crevier |
| D925,009 | S | 7/2021 | Brown et al. |
| 11,198,997 | B2 | 12/2021 | Brown et al. |
| 11,396,745 | B2 | 7/2022 | Brown et al. |
| D960,329 | S | 8/2022 | Brown et al. |
| 11,505,935 | B2 | 11/2022 | Crevier |
| 11,585,078 | B2 | 2/2023 | Brown et al. |
| 11,781,305 | B2 | 10/2023 | Brown et al. |
| D1,039,121 | S | 8/2024 | Brown et al. |
| 2002/0037385 | A1 | 3/2002 | Pignot et al. |
| 2003/0044326 | A1 | 3/2003 | Yamasaki et al. |
| 2005/0133516 | A1 | 1/2005 | Liao et al. |
| 2005/0022298 | A1 | 2/2005 | de Leon et al. |
| 2005/0067106 | A1 | 3/2005 | Melges |
| 2005/0112339 | A1 | 5/2005 | Sandel et al. |
| 2005/0144711 | A1 | 7/2005 | Valadez et al. |
| 2005/0169793 | A1 | 8/2005 | Wheatley et al. |
| 2005/0245671 | A1 | 11/2005 | Moon et al. |
| 2005/0283892 | A1 | 12/2005 | Simeone et al. |
| 2006/0232059 | A1 | 10/2006 | Fortune et al. |
| 2006/0260032 | A1 | 11/2006 | Smartt |
| 2007/0023539 | A1 | 2/2007 | Brown et al. |
| 2007/0039089 | A1 | 2/2007 | Worrel |
| 2007/0044221 | A1 | 3/2007 | Wise |
| 2007/0161927 | A1 | 7/2007 | Daugirdas |
| 2007/0186337 | A1 | 8/2007 | Emr |
| 2007/0266486 | A1 | 11/2007 | Ramirez |
| 2007/0286984 | A1 | 12/2007 | Wright |
| 2008/0098505 | A1 | 5/2008 | Casari |
| 2008/0100057 | A1 | 5/2008 | MacPhee |
| 2008/0292509 | A1 | 11/2008 | D'Amico |
| 2009/0070923 | A1 | 3/2009 | Ruedas |
| 2009/0229511 | A1 | 9/2009 | Campbell et al. |
| 2009/0255053 | A1 | 10/2009 | Cutrone, III |
| 2010/0183694 | A1 | 7/2010 | Burke et al. |
| 2010/0257664 | A1 | 10/2010 | Kener |
| 2011/0296597 | A1 | 12/2011 | Brown |
| 2014/0007336 | A1 | 1/2014 | Mills et al. |
| 2014/0075663 | A1 | 3/2014 | Irwin et al. |
| 2014/0076991 | A1 | 3/2014 | Irwin et al. |
| 2014/0157501 | A1 | 6/2014 | D'Amico |
| 2014/0259344 | A1 | 9/2014 | Muderlak et al. |
| 2015/0047114 | A1 | 2/2015 | Ramirez |
| 2016/0102451 | A1 | 4/2016 | Brown et al. |
| 2017/0067243 | A1 | 3/2017 | Valencia Garcia |
| 2017/0096808 | A1 | 4/2017 | D'Amico et al. |
| 2018/0023278 | A1 | 1/2018 | Brown et al. |
| 2018/0080210 | A1 | 3/2018 | Hurd et al. |
| 2018/0119403 | A1 | 5/2018 | Crevier |
| 2018/0347161 | A1 | 12/2018 | Malesky et al. |
| 2019/0145088 | A1 | 5/2019 | Keune |
| 2019/0292764 | A1 | 9/2019 | Crevier |
| 2022/0412066 | A1 | 12/2022 | Dalton |
| 2024/0011273 | A1 | 1/2024 | Brown et al. |
| 2024/0133171 | A1 | 4/2024 | Brown et al. |

FOREIGN PATENT DOCUMENTS

| | | | |
|---|---|---|---|
| CN | 103321290 | | 9/2013 |
| CN | 203296150 | U | 11/2013 |
| CN | 203458322 | | 3/2014 |
| CN | 203905131 | U | 10/2014 |
| CN | 206346295 | U | 7/2017 |
| DE | 1915249 | A1 | 10/1970 |
| DE | 19541911 | A1 | 5/1997 |
| DE | 102012005147 | A1 | 9/2013 |
| EP | 0153946 | A1 | 9/1985 |
| EP | 3081705 | A1 | 10/2016 |
| EP | 3202990 | | 8/2017 |
| FR | 2618173 | | 1/1989 |
| FR | 2681232 | A1 | 3/1993 |
| GB | 189518394 | A | 8/1896 |
| GB | 350854 | A | 6/1931 |
| GB | 2092216 | | 8/2000 |
| GB | 2431101 | A | 4/2007 |
| GB | 2473273 | A | 3/2011 |

(56) References Cited

FOREIGN PATENT DOCUMENTS

| | | | | |
|---|---|---|---|---|
| GB | 2472377 | | 9/2011 | |
| JP | 57-17599 | | 1/1982 | |
| JP | 60-178497 | | 11/1985 | |
| JP | 60-190865 | | 12/1985 | |
| JP | 63-116585 | | 7/1988 | |
| JP | 1990-102625 | A | 4/1990 | |
| JP | 1992-119880 | U | 10/1992 | |
| JP | 2001-303642 | | 10/2001 | |
| JP | 2017-186861 | | 10/2017 | |
| KR | 100351178 | | 5/2002 | |
| KR | 20-0337763 | | 1/2004 | |
| KR | 20-0351953 | Y1 | 5/2004 | |
| KR | 0368846 | U | 11/2004 | |
| KR | 20-0395055 | Y1 | 9/2005 | |
| WO | WO 98/30621 | A1 | 7/1998 | |
| WO | WO 2005/093177 | | 10/2005 | |
| WO | WO 2014/043725 | A1 | 3/2014 | |
| WO | WO 2015/088303 | | 6/2015 | |
| WO | WO 2016/060998 | A1 | 4/2016 | |
| WO | WO-2016144153 | A1 * | 9/2016 | ..... B65D 90/52 |
| WO | WO 2019/126217 | A1 | 6/2019 | |

OTHER PUBLICATIONS

Defendant Impact Products, LLC, Answer And Affirmative Defenses Demand For Jury Trial, Case No. 2:19-cv-05994 GW(AFMx), filed Sep. 4, 2019.

Fresh Products, Inc.'s First Amended Complaint, Case No. 3:19-cv-02109-JZ, with Exhibits, filed Feb. 4, 2020 in 55 pages.

Defendant Impact Products, LLC's Answer and Affirmative Defenses to First Amended Complaint, Case No. 3:19-cv-02109-JZ, filed Feb. 18, 2020 in 9 pages.

Defendant Impact Products, LLC, Invalidity Contentions, Demand For Jury Trial, Case No. 3:19-cv-02109-JZ, with Exhibits, filed Apr. 8, 2020 in 813 pages.

Fresh Products, Inc.'s Opening Claim Construction Brief, Case No. 3: 19-cv-02109-JZ, filed Aug. 4, 2020 in 30 pages.

Defendant Impact Products, LLC's Opening Claim Construction Brief, Case No. 3:19-cv-02109-JZ, with Exhibits, filed Aug. 4, 2020 in 370 pages.

Defendant Impact Products, LLC's Responsive Claim Construction Brief, Case No. 3:19-cv-02109-JZ, with exhibits, dated Sep. 3, 2020.

Fresh Products, Inc.'s Responsive Claim Construction Brief, Case No. 3:19-cv-02109-JZ, dated Sep. 3, 2020.

Joint Claim Construction and Prehearing Statement, Case No. 3:19-cv-02109-JZ, dated Sep. 8, 2020.

Joint Notice of Additional Agreed-Upon Claim Constructions, Case No. 3:19-cv-02109-JZ, dated Oct. 28, 2020.

Transcript of Video Claim Construction Hearing Proceedings Before the Honorable Jack Zouhary, United States Senior District Judge, Case No. 3:19-CV-2109, dated Nov. 16, 2020.

Joint Notice of Additional Agreed-Upon Claim Constructions, Case No. 3:19-cv-02109-JZ, dated Nov. 17, 2020.

Markman Order, Case No. 3: 19-cv-02109-JZ, dated Nov. 24, 2020.

Dismissal and Order re Validity and Enforceability, Case No. 3:19-cv-02109-JZ, dated Feb. 3, 2021.

Non-Infringement and Invalidity Contentions [with Exhibits 1-7], Case No. CIV-21-00211-F, dated Aug. 20, 2021.

Order Regarding Claim Construction, *Big D Industries, Inc.,* v. *Fresh Products, Inc*., Case No. 5:21-cv-00211-F, May 6, 2022.

Order Regarding Claim Construction, *Big D Industries, Inc.,* v. *Fresh Products, Inc*., Case No. 5:21-cv-00211-F, Apr. 5, 2022.

Complaint, *Big D Industries, Inc.,* v. *Fresh Products, Inc*., Case No. 5:22-cv-00182-PRW, Mar. 2, 2022.

Fresh Products Final Infringement Contentions, *Big D Industries, Inc.,* v. *Fresh Products, Inc*., Case No. 5:21-cv-00211-F, Jun. 15, 2022.

Expert Report of Nathan J. Macdonald, Case No. CIV-21-211-F, Oct. 21, 2022.

Expert Report of Randy Hurd, PH.D., Case No. 5:21-cv-00211-F, Sep. 23, 2022.

Declaration of Sean Stewart, dated Mar. 23, 2022, with exhibits, in 30 pages.

Fresh Products, Inc., The Wave 2.0 Flyer, in 1 page.

Big D Product Catalog, Jan. 2013, in 16 pages.

Dugdale, David C., "Uroflowmetry" MedlinePlus Medical Encyclopedia, 2008. http://www.nlm.nih.gov/medlineplus/ency/article/003325.htm, retrieved on Oct. 28, 2014, 2 pages.

Fresh Products Tidal Wave Urinal Screen, YouTube Video Frame 0: 19/1 :23, Publish Date Sep. 20, 2017, Visited Online May 26, 2020, https://www.youtube.com/watch?v=G_g2_ 1NtE21&feature=emb_logo (Year: 2017).

Fresh Products 3WDS60SAP Wave 3-D Urinal Deodorizer Screen, Red; Spiced Apple Fragrance; indicated as first available date May 10, 2013; visited online Feb. 5, 22; https://www.amazon.com/Fresh-Products-3WDS60SAP-Deodorizer-Fragrance/dp/B00MX5A9ME/ref=pd_lpo_2?pd_rd_i=B00MX5A9ME&psc=1.

Fresh Products Wave 3-D Urinal Screen, Herbal Mint; indicated as first available date Sep. 3, 2014; visited online Feb. 5, 2022; https://www.amazon.com/Fresh-Products-Urinal-Screen-Herbal/dp/B00NA58YGE.

Gray, Henry. "The Male Urethra". Anatomy of the Human Body, 3b. 4, 1918. http://www.bartleby.com/107/256.html, retrieved on Oct. 27, 2014. 5 pages.

Ritter, R. C. et al., "Analysis of Drop Intervals in Jets Modelling Obstruction of the Urinary Tract," Physics in Medicine and Biology, 1974, vol. 19, No. 2, 161-170, 11 pages.

Ritter, R. C. et al., "Physical Information in the External Urinary Stream of the Normal and Obstructed Adult Male, " British Journal of Urology, 1977, vol. 49, 293-302, 10 pages.

Fresh Products Slant7 urinal screen, best splash prevention, easy installation, long-lasting fragrance—fabulous, purple, made in USA, lasts for 30 days, 10pk urinal screens, available in Amazon.com, date first available Aug. 7, 2020, site visited Jul. 19, 2023, https://www.amazon.com/Fresh-Products-Prevention-Installation-Long-Lasting/dp/B08FF94W2B (2020).

The Pearl 3D® urinal screen product cut sheet, and 3D renderings of The Pearl 3D urinal screen product, in three pages. The cut sheet includes a date of Sep. 2013; however, Applicant makes no representations as to the accuracy of this date. Applicant further makes no representation as to whether the 3D renderings accurately represent the product shown in the cut sheet and as to whether the 3D renderings accurately represent any prior art product. Applicant requests that the Examiner review the reference as prior art. Applicant reserves the right to disqualify the reference as prior art if needed.

Fresh Products, Inc.'s Answer to Complaint and Counterclaim, Case No. 0:24-cv-01454-JMB-ECW, May 9, 2024.

Complaint for Declaratory Judgement of Invalidity and Noninfringement, *Vectair Systems Inc.* v. *Fresh Products, Inc*., Case No. 0:24-cv-01454-JMB-ECW, Apr. 20, 2024, with exhibits.

Petition for Inter Partes Review of U.S. Pat. No. 10,145,098, *Vectair Systems Inc.* v. *Fresh Products, Inc*., Apr. 19, 2024, with exhibits.

Patent Owner Preliminary Response, *Vectair Systems Inc.,* Petitioner, v. *Fresh Products, Inc*., Patent Owner, Case No. IPR2024-00824, U.S. Pat. No. 10,145,098, dated Aug. 13, 2024, in 49 pages.

Vectair Systems Inc.'s Invalidity Contentions, *Vectair Systems Inc*., Plaintiff and Counterclaim Defendant, v. *Fresh Products, Inc*., Defendant and Counterclaimant, Civil No. 0:24-cv-01454-JMB-ECW, dated Aug. 24, 2024, in 829 pages.

Fresh Products, Inc.'s Answer to Complaint and First Amended Counterclaim, *Vectair Systems Inc*., Plaintiff, v. *Fresh Products, Inc*., Defendant, *Fresh Products, Inc*. Counter-Claimant, v. *Vectair Systems Inc*., Counter-Defendant, Case No. 0:24-cv-01454-JMB-ECW, filed on May 30, 2024, in 119 pages.

Vectair's Answer to Fresh Products, Inc.'s First Amended Counterclaim, Case No. 0:24-cv-01454-JMB-ECW, filed on Jun. 13, 2024, in 26 pages.

(56) References Cited

OTHER PUBLICATIONS

Fresh Products, Inc.'s Answer to "Vectair's Additional Counterclaim", Case No. 0:24-cv-01454-JMB-ECW, filed on Jul. 3, 2024, in 12 pages.

* cited by examiner

URINAL SCREENS

CROSS REFERENCE TO RELATED APPLICATIONS

Any and all applications for which a foreign or domestic priority claims is identified in the Application Data Sheet as filed with the present application are hereby incorporated by reference under 37 CFR 1.57.

TECHNICAL FIELD

Certain embodiments discussed herein relate to restroom screens and mats, and, more particularly, the present inventions relate to restroom urinal screens and mats.

DISCUSSION OF THE RELATED ART

Urinal screens are widely used as air fresheners and to prevent debris from being flushed down a urinal drain. In some cases, a fragrance is provided with the screens to help sanitize and freshen the air in and around the urinal.

SUMMARY OF THE INVENTIONS

A urinal screen can include a frame. In some embodiments, the frame has a first face and a second face opposite the first face. The frame can include a plurality of openings extending through the first face and the second face. In some cases, the screen includes a plurality of first posts extending from the first face of the frame. The screen can include a plurality of second posts extending from the second face of the frame.

According to some variants, the portion of the frame defining each of the openings has a polygonal perimeter structure. In some embodiments, each perimeter structure defining an opening has a plurality of braces and corners. In some cases, a plurality of the braces and corners are shared between two or more openings. In some embodiments, the braces and corners form a tessellation. According to some variants, each of plurality of first posts extends from the portion of the frame defining a corner of a perimeter structure forming one or more of the plurality of openings. In some cases, each of plurality of second posts extends from a midpoint of a brace of a portion of the frame defining a perimeter structure forming one or more of the plurality of openings. In some embodiments, at least one of the plurality of second posts extends from each of the braces of the perimeter structure defining the openings. In some cases, at least one of the plurality of first posts extends from each of the corners of the perimeter structure defining the openings. In some embodiments, at least one of the plurality of second posts extends from each of the braces of the perimeter structure defining the openings and at least one of the plurality of first posts extends from each of the corners of the perimeter structure defining the openings. According to some variants, at least one of the plurality of second posts extends from a brace or corner of the portion of the perimeter structure defining each opening. In some embodiments, at least one of the plurality of first posts extends from a brace of the perimeter structure defining each opening or corner of the perimeter structure defining each opening. In some cases, each of the plurality of first posts is substantially identical to one or more of the plurality of second posts.

According to some variants, a thickness of the frame in a direction perpendicular to the first face of the frame is less than one fourth of an overall thickness of the urinal screen in the direction perpendicular to the first face of the frame. In some cases, a thickness of the frame in a direction perpendicular to the first face of the frame is less than one eighth of an overall thickness of the urinal screen in the direction perpendicular to the first face of the frame. In some embodiments, when the urinal screen is set upon a surface such that the first or second face of the frame is oriented toward the surface, the frame is positioned away from the surface by at least one third of a thickness of the urinal screen as measured perpendicular to the first face of the frame. In some cases, the plurality of openings occupy at least three fourths of a surface area of the frame as measured parallel to the first face (e.g., the first plane) of the frame. In some embodiments, the perimeter structures defining the plurality of openings occupy less than one fifth of a surface area of the frame as measured parallel to the first face (e.g., the first plane) of the frame.

According to some variants, a urinal screen includes a frame. The frame can have: a first face; a second face opposite the first face; and a plurality of openings extending through the frame between the first face and the second face. The urinal screen can include a plurality of first posts extending from the first face of the frame. In some embodiments, the urinal screen includes a plurality of second posts extending from the second face of the frame. In some embodiments, a plurality of ends of the plurality of second posts form a base upon which the urinal screen rests when the plurality of first posts point away from a surface upon which the urinal screen is set. In some embodiments, at least half of the plurality of first posts are a same size and shape as at least half of the plurality of second posts.

In some configurations, each of the openings is defined by a polygonal perimeter structure.

In some configurations, each opening is defined by a perimeter structure having plurality of braces and corners.

In some configurations, each of plurality of first posts extends from a corner of a perimeter structure of one or more of the plurality of openings.

In some configurations, each of plurality of second posts extends from a midpoint of a brace of a perimeter structure of one or more of the plurality of openings.

In some configurations, at least one of the plurality of second posts extends from each of the braces of the perimeter structure defining the openings.

In some configurations, at least one of the plurality of first posts extends from each of the corners of the perimeter structure defining the openings.

In some configurations, at least one of the plurality of second posts extends from each of the braces of the openings. In some configurations, at least one of the plurality of first posts extends from each of the corners of the perimeter structure defining the openings.

In some configurations, at least one of the plurality of second posts extends from a brace or corner of the perimeter structure defining each opening.

In some configurations, at least one of the plurality of first posts extends from a brace or corner of the perimeter structure defining each opening.

In some configurations, a thickness of the frame in a direction perpendicular to the first face of the frame is less than one eighth of an overall thickness of the urinal screen in the direction perpendicular to the first face of the frame.

In some configurations, when the urinal screen is set upon a surface such that the first or second face of the frame is oriented toward the surface, the frame is positioned away from the surface by at least one third of a thickness of the urinal screen as measured perpendicular to the first face of the frame.

According to some variants, a urinal screen includes a frame. The frame can have: a first face; a second face opposite the first face; and a plurality of openings extending through the frame between the first face and the second face. In some embodiments, the urinal screen includes a plurality of first posts extending from the first face of the frame. The urinal screen can include a plurality of second posts extending from the second face of the frame. In some embodiments, the plurality of openings occupy at least half of a surface area of the frame as observed perpendicular to the first face of the frame when the frame is set on a flat surface. In some case, the plurality of openings occupy at least 75% of the surface area of the frame as observed perpendicular to the first face of the frame when the frame is set on a flat surface.

In some configurations, each of the plurality of first posts is substantially identical to one or more of the plurality of second posts.

In some configurations, the perimeter structures of the plurality of openings occupy less than one fifth of a surface area of the frame as measured parallel to a first plane face of the frame, wherein the first plane face of the frame is a plane passing through the frame when the frame is set on a flat horizontal surface.

According to some variants, a urinal screen includes a frame. The frame can include: a first face; a second face opposite the first face; and a plurality of interconnected cells, each cell having a polygonal shape with a plurality of sides and corners. In some embodiments, the urinal screen includes a plurality of first posts extending from away from the first face, each of the plurality of first posts connected to a side or corner of the plurality of interconnected cells. In some embodiments, the urinal screen include a plurality of second posts extending away from the second face of the frame, each of the plurality of second posts connected to a side or corner of the plurality of interconnected cells. In some cases each of the interconnected cells shares at least one side and at least one corner with another interconnected cell.

In some configurations, the plurality of interconnected cells form a tessellation.

In some configurations, a thickness of the frame in a direction perpendicular to the first face of the frame is less than one fourth of an overall thickness of the urinal screen in the direction perpendicular to the first face of the frame.

BRIEF DESCRIPTION OF THE DRAWINGS

The present inventions are described with reference to the accompanying drawings, in which like reference characters reference like elements, and wherein.

DETAILED DESCRIPTION OF THE INVENTIONS

Figure 1:
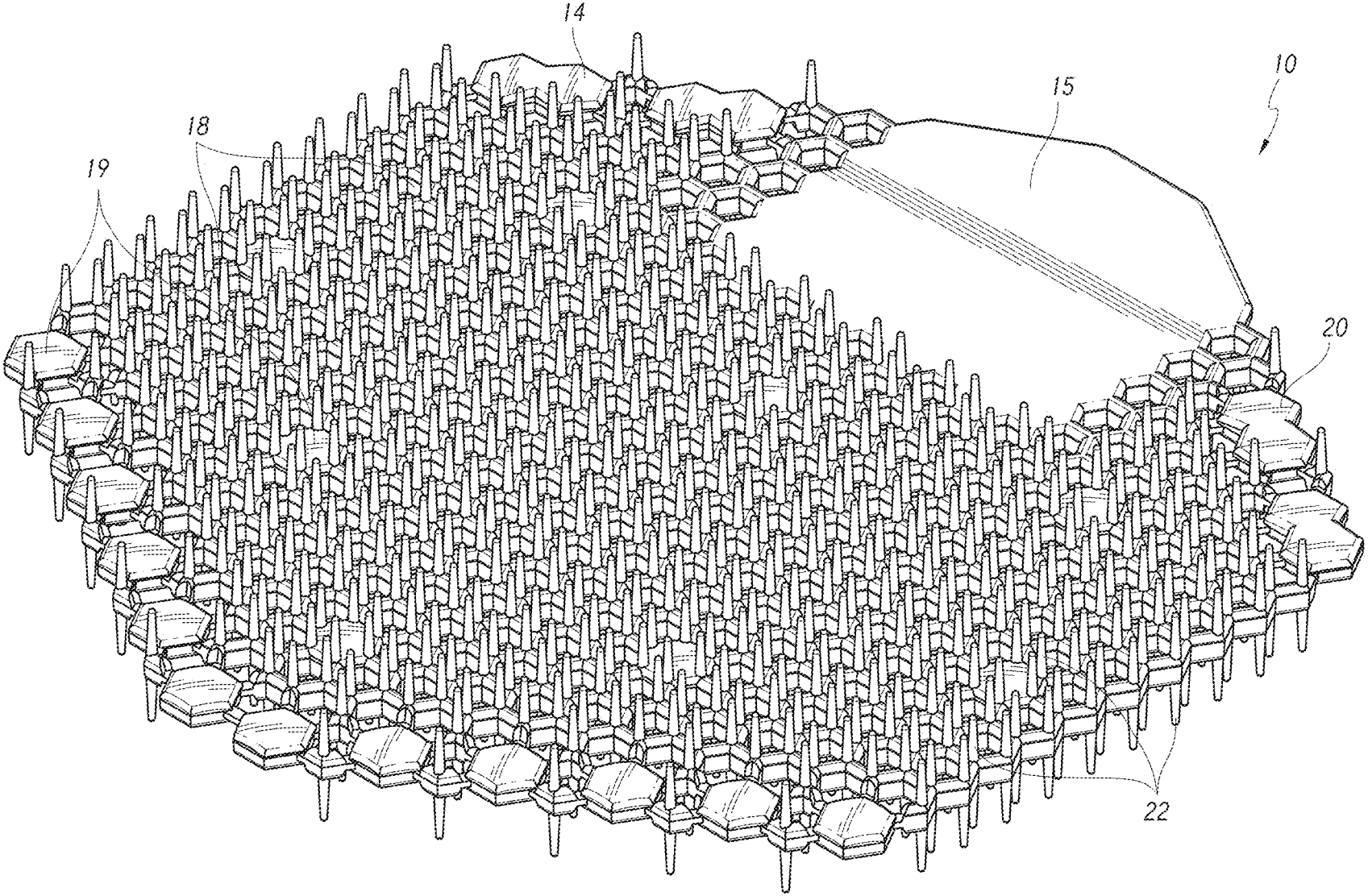
FIG. 1 is a perspective view of an embodiment of a urinal screen.
Figure 2:
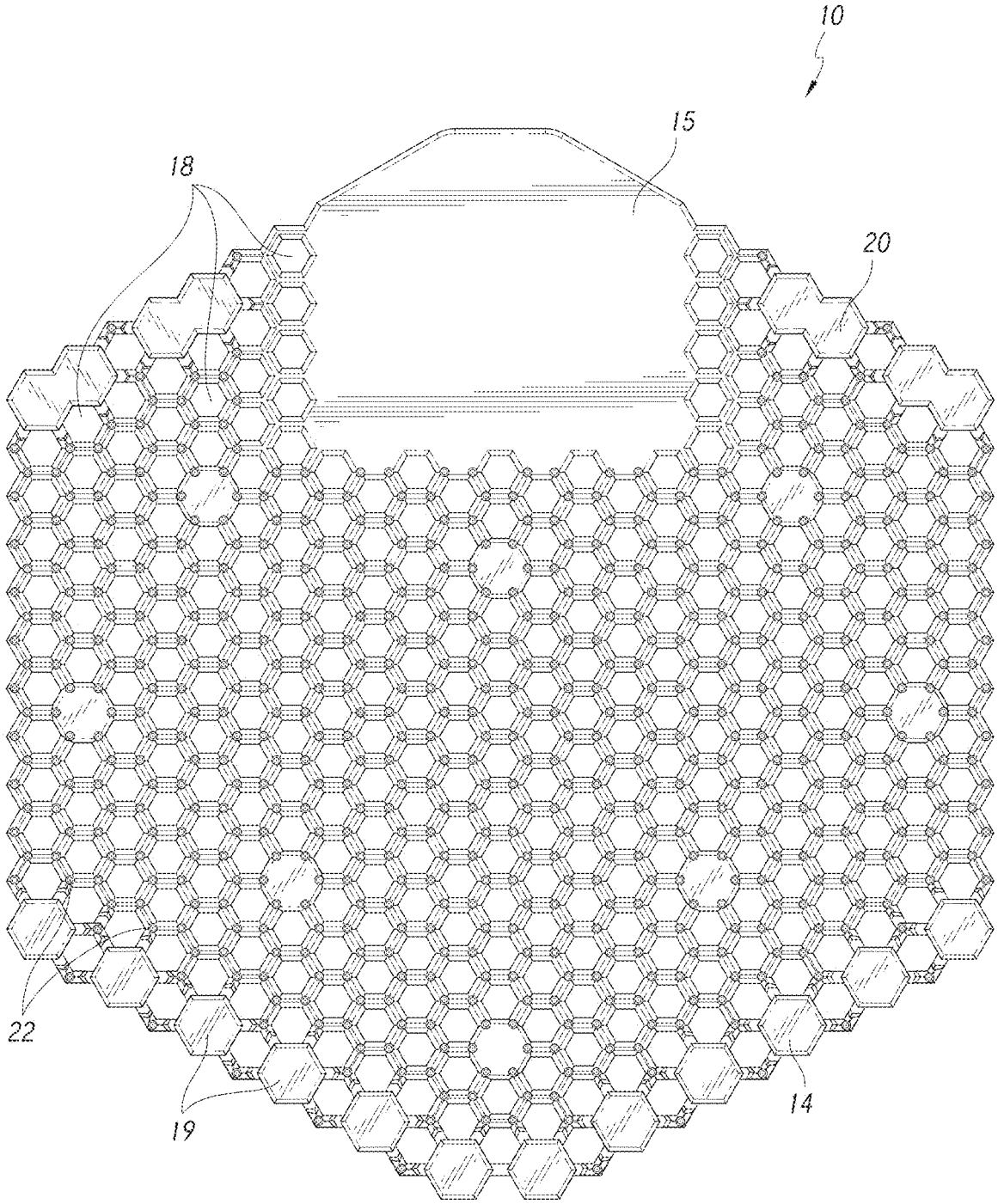
FIG. 2 is a top view of the urinal screen of FIG. 1.

An embodiment of a urinal screen 10 is illustrated in FIGS. 1-2. The urinal screen 10 can be sized and shaped to fit into a urinal, toilet, or other bathroom appliance. As illustrated, the urinal screen 10 can include a frame 14. The frame 14 can be sized and shaped to fit over all or a portion of a drain of a toilet or urinal. The frame 14 can define a plurality of openings 18 through a thickness of the frame 14. In some embodiments, the urinal screen 10 includes a plurality of posts or structural supports 22 extending from one or more surfaces of the frame 14.

In some embodiments, the screen 10 has a polygonal, elliptical, circular, or other overall shape. For example, as illustrated in FIG. 2, the screen 10 can have a generally hexagonal shape, though many other shapes are contemplated (e.g., rectangles, pentagons, triangles, circles, or some combination thereof). In some embodiments, the screen 10 is shaped to fit a particular urinal or toilet.

The frame 14 and/or posts 22 can be constructed from a polymeric or solid material. For example, the frame 14 and/or posts 22 can be constructed using a 3D printer. In some cases, additives are added to the material of the frame 14 and/or posts 22. Additives can include, for example, bacteria and/or odor neutralizers, silver ions, and other additives or combinations of additives. One method of manufacturing an embodiment of the urinal screen 10 can include providing plastic or EVA material, which may have a melting point of not greater than 250° F., loading the plastic or EVA with at least 15% to about 75% by weight of fragrance material to produce a fragranced plastic or EVA, loading the fragrance at a stage conducted at temperatures such that the fragranced plastic or EVA is from at least 15% by weight fragrance upon completion of the loading stage, and molding the fragranced plastic or EVA into a urinal screen, sized and shaped to be disposed in a urinal, forming openings 18 in the frame 14, and forming posts 22 extending from the frame 14.

The openings 18 can have various shapes, including, but not limited to, polygons (e.g., triangles, rectangles, pentagons, hexagons, etc.), ellipses, and/or some combination thereof. In some embodiments, each of the openings 18 has a substantially identical shape. In some embodiments, one or more of the openings 18 has a different shape from one or more of the other openings.

The openings 18 can occupy a large percentage of the overall surface area of the frame 14 as viewed in FIG. 2. For example, the openings 18 can occupy more than ⅛, more than ⅔, more than ⅓, more than ¼, more than ⅜, more than ½, more than ⅝, more than ⅔, and/or more than ¾ of the overall surface area of the frame 14 as viewed in FIG. 2. Utilizing a large number of openings 18 can reduce the overall weight of the urinal screen 10.

A top surface (e.g., the first surface 26) of the frame 14 can lie on a first plane when the urinal screen 10 is set on a flat surface. In some cases, a bottom surface (e.g., the second surface 30) of the frame 14 can lie on a second plane when the urinal screen is set on a flat surface. In some embodiments, a maximum cross-sectional area of the frame 14 (e.g., the area not occupied by openings 18), as measured on a frame plane through the frame and parallel to the first and/or second planes is less than ½, less than ¼, less than ⅕, less than ⅙, less than ⅐, less than ⅛, less than ⅙, less than 1/10, less than 1/12, less than 1/15, and/or less than 1/20 of the area defined by the outer perimeter of the frame as measured in the plane. Many variations are possible.

Figure 3:
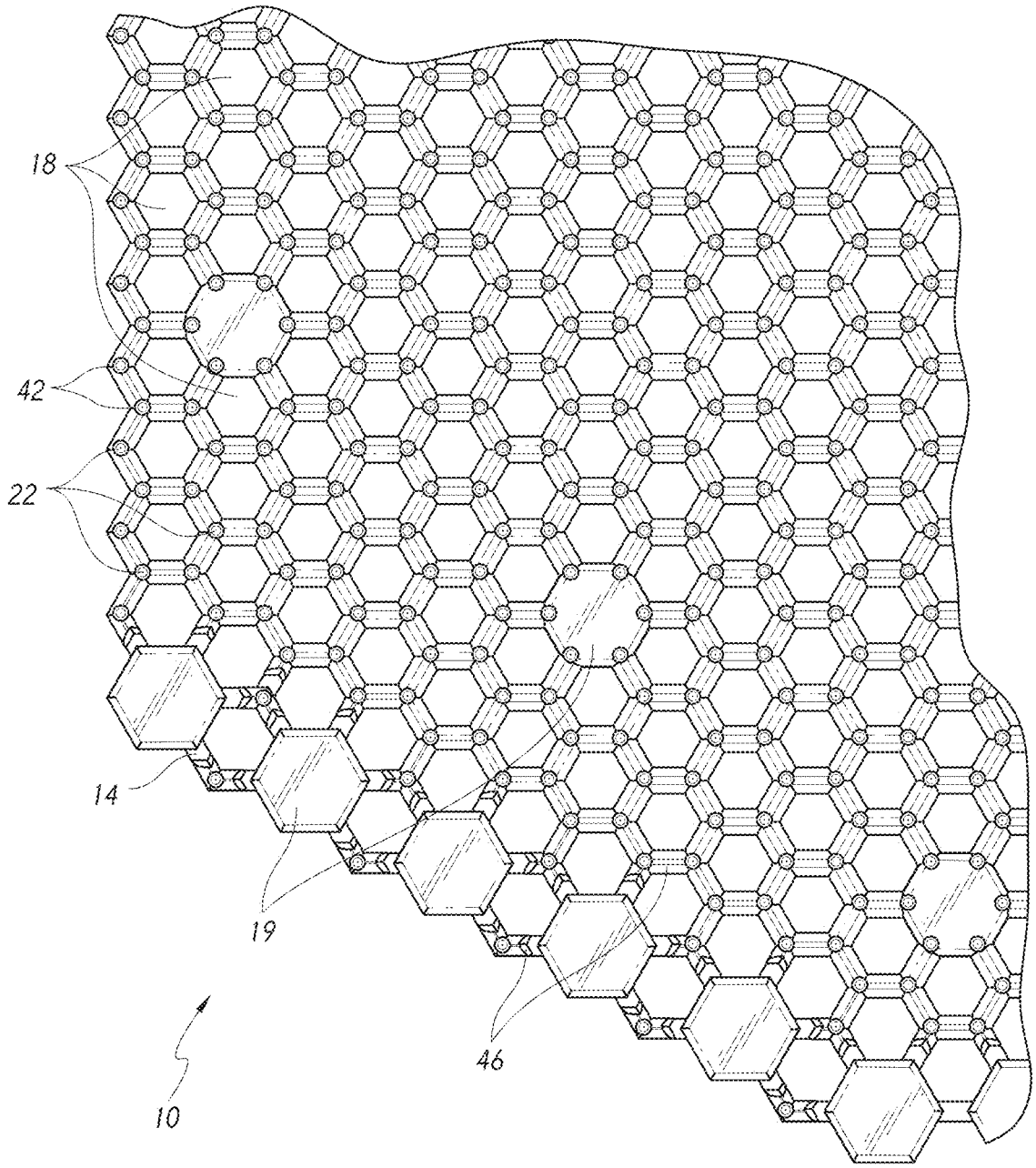
FIG. 3 is a front view of the urinal screen of FIG. 1.

As illustrated in FIGS. 2 and 3, one or more of the openings 18 (e.g., cells) can have a perimeter which includes a plurality of sides (e.g., braces) 42 and corners 46. In some cases, all or a portion of the frame 14 forms a tessellation of openings 18 wherein a plurality of the sides 42 of the openings 18 are shared between two or more openings 18. In some embodiments, each of the openings 18 shares at least one side and at least one corner with another opening.

In some cases, the sides 42 and/or corners 46 of the openings 18 have contoured (e.g., convex) upper and/or lower surfaces. The contoured surfaces of the sides 42 and corners 46 can deflect fluid (e.g., urine) to reduce splash in the urinal, toilet, or other environment in which the urinal screen 10 is installed.

In some embodiments, as illustrated in FIGS. 1 and 2, portions of the frame 14 include one or more solid or closed portions between or surrounding the openings 18. For example, the frame 14 can include one or more solid cells 19 positioned between and/or adjacent the openings 18 of the frame 14. The solid cells 19 can provide a surface area on which various letters, numbers, symbols, trademarks, and/or other visual features may be placed. For example, advertisements, installation instructions, date features, expiration dates, and/or other features may be included on the solid cells 19. In some embodiments, the frame 14 includes one or more intermediate solid cells 20 and/or large solid cells 15 for placement of larger/more complex visual features. For example, the intermediate solid cells 20 can occupy an area greater than or equal to 2, 3, 4, 5, and/or 6 openings 18. In some embodiments, the large solid cell 15 can occupy an area greater than or equal to 10 openings 18. Many variations are possible. In some embodiments, the one or more solid or closed portions facilitate easier removal of the screen 10 from a mold. In some cases, utilizing solid portions increases an amount of fragrance that can be embedded, coated, injected, or otherwise associated with the screen 10.

Figure 4:
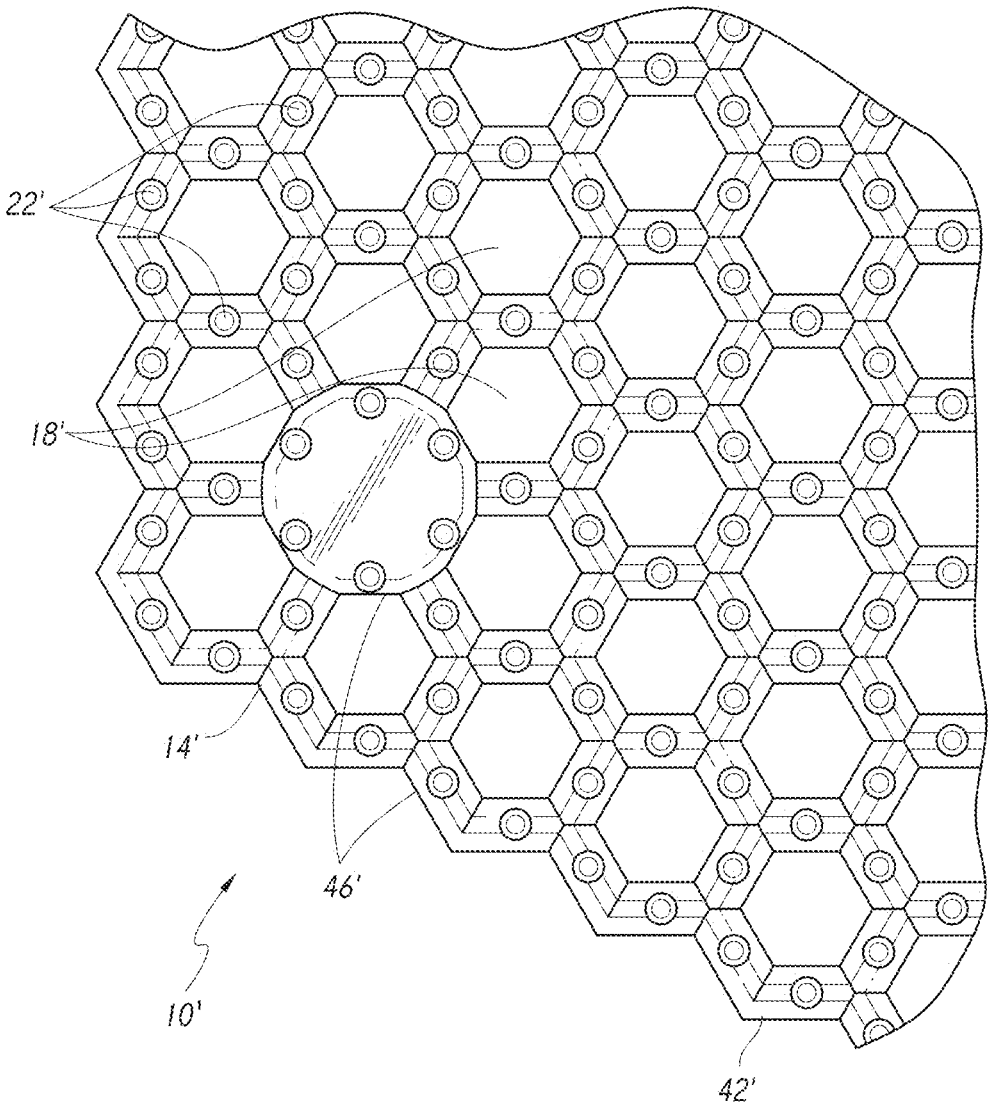
FIG. 4 is a close up top view of the urinal screen of FIG. 1.

In some embodiments, the posts 22 extend from the corners 46 of the frame forming openings 18. FIG. 4 illustrates an embodiment of a screen 10' wherein the posts 22' extend from the sides 42' (e.g., the midpoints of the sides 42') of the portions of the frame forming the openings 18' of the frame 14'. In some embodiments, posts 22 extend from both the portions of the fame forming the corners 46 and the portions of the frame forming the sides 42 or from some combination thereof. In some embodiments, posts 22 extend from the portions of the frame forming the corners 46 of the openings 18 on one side of the frame 14 (e.g., the first side 26, as shown in FIG. 5) and from the portions of the frame forming the sides 42 of the openings 18 on the other side of the frame 14 (e.g., the second side 30).

Figure 5:
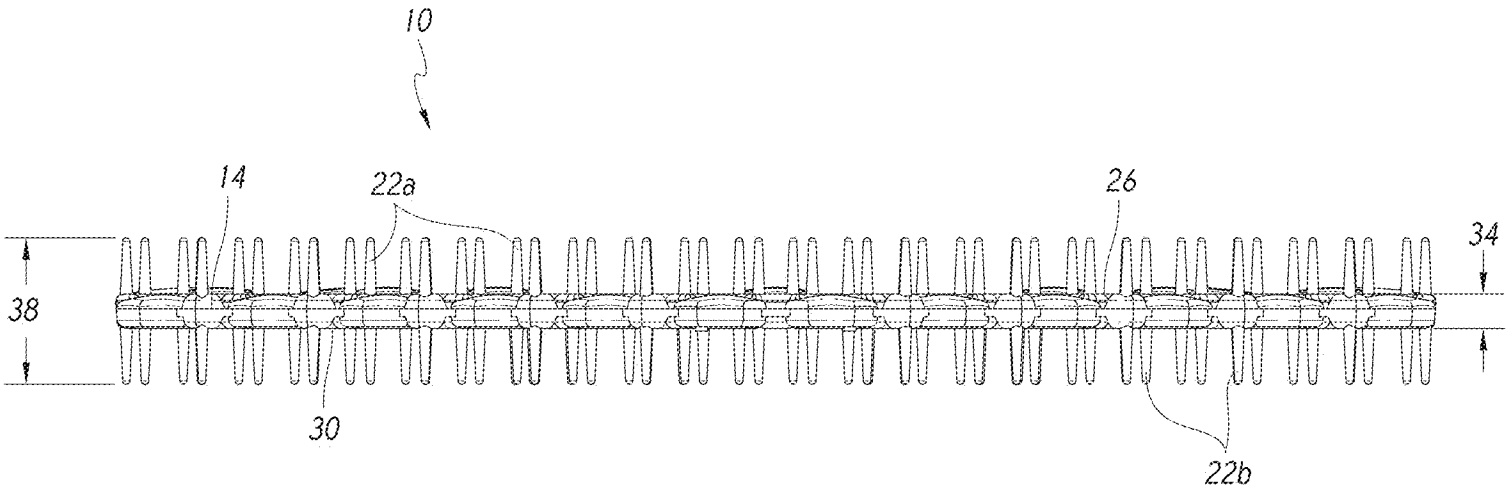
FIG. 5 is a close up top view of another embodiment of a urinal screen.

As illustrated in FIG. 5, the posts 22 can extend from a first surface 26 of the frame 14. In some embodiments, posts 22 extend from both the first surface 26 of the frame 14 and a second surface 30 of the frame 14. For example, a first plurality of posts 22*a* can extend from the first surface 26 of the frame 14 and a second plurality of posts 22*b* can extend from the second surface 30 of the frame 14. Each of the posts in the first plurality of posts 22*a* can be substantially identical to the each of the posts in the second plurality of posts 22*b*. For example, each of the posts can have the same height, width and/or overall shape.

Figure 6:
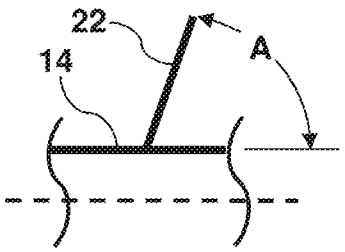
FIG. 6 is a schematic side view of a post extending from a frame of a urinal screen at a non-perpendicular angle.

In some embodiments, at least half, at least ¾, at least ⅕, at least ⅔, at least ⅓, at least 9/10, at least ⅘ and/or at least 1/10 of the first plurality of posts 22*a* have a same size and shape as at least half, at least ¾, at least ⅕, at least ⅔, at least ⅓, at least 9/10, at least ⅘ and/or at least 1/10 of the second plurality of posts 22*b*. In some embodiments, one or more of the posts in the first plurality of posts 22*a* has a different shape and/or height than one or more of the posts in the second plurality of posts 22*b*. In some embodiments, the first plurality of posts 22*a* and/or the second plurality of posts 22*b* have a plurality of heights. For example, a percentage (e.g., 25%, 50%, 75% or some other percentage) of the posts 22 can be shorter than the remaining posts as measured from the first or second surfaces 26, 30 of the frame 14. In some embodiments, at least ⅘, at least ⅗, at least ½, and/or at least ¼ of the posts 22 have a height differing from the remaining posts 22. In some embodiments, one or more of the posts 22 is at least ⅕, at least 1/10, at least ⅛, at least ¼, and/or at least ⅓ shorter than one or more of the other posts 22. In some cases, each post is at least ⅕ shorter, at least 1/10 shorter, at least ⅛ shorter, at least ¼ shorter, at least ⅓ shorter, at least ½ taller, at least ¼ taller, at least ⅛ taller, at least 1/10 taller, and/or at least 1/16 taller than at least one of the 3 closest posts 22, at least one of the 5 closest posts 22, at least one of the 7 closest posts 22, at least one of the 9 closest posts 22, at least one of the 10 closest posts 22, at least one of the 12 closest posts 22, and/or at least one of the 15 closest posts 22. In some embodiments, shortening a percentage of the posts 22 can reduce the likelihood that debris is caught in the urinal screen 10. The posts 22 can extend perpendicularly from the frame 14 (e.g., from the first or second surfaces 26, 30 of the frame 14). In some embodiments, one or more of the posts 22 extends from the frame 14 at a non-perpendicular angle (for example, non-perpendicular angle A of FIG. 6).

The frame 14 can have a generally planar or flat shape. In some embodiments, the frame 14 is curved or otherwise shaped in non-planar fashion. For example, the frame 14 can be molded in a non-planar shape to match the contours of a urinal or toilet.

The frame 14 can have a frame thickness 34 (e.g., a distance between the first and second surfaces 26, 30 of the frame 14). The frame thickness 34 can be uniform across the entire frame 14 or can vary in certain portions of the frame 14. An overall thickness 38 of the urinal screen 10 can be measured from a tip of the tallest post 22 extending from the first surface 26 of the frame 14 to a tip of the tallest post 22 extending from the second surface 30 of the fame 14 as measured perpendicularly from the first and second surfaces 26, 30. In some cases, wherein the frame 14 is not planar/flat, the overall thickness 38 of the urinal screen 10 can be determined via the tips of the posts 22 as measured perpendicularly to a tangent plane of the first surface 26 of the frame 14 at a point on the frame 14 where the thicknesses 34, 38 are being measured.

In some embodiments, the frame thickness 34 at a given position on the frame 14 is less than or equal to approximately ½ of the overall screen thickness 38 as measured perpendicularly to the first surface 26 of the frame 14 at the given position. In some embodiments, the frame thickness 34 is less than or equal to ⅔, less than or equal to ⅝, less than or equal to ⅜, less than or equal to ⅓, less than or equal to ¼, less than or equal to ⅖, less than or equal to ⅛, less than or equal to 1/10, less than or equal to 1/16, and/or less than or equal to 1/32 of the overall screen thickness 38. Use of a thin frame 14 can reduce the overall weight of the urinal screen 10.

In some embodiments, the urinal screen 10 is configured such that a plurality of posts 22 space the frame 14 from the installation surface of a urinal or other fixture onto which the urinal screen 10 is installed. The posts 22 space the frame 14 from the installation surface independent from the orientation of the urinal screen 10. For example, the second plurality of posts 22*b* can form a base of the urinal screen 10 and can space the frame 14 from the installation surface when the screen 10 is installed with the second surface 30 of the frame 14 facing the installation surface. On the other hand, the first plurality of posts 22*a* can form a base of the urinal screen 10 and can space the frame 14 from the installation surface when the screen 10 is installed with the first surface 26 of the frame facing the installation surface. In some embodiments, the posts 22 space the frame 14 from the installation surface by at least ⅓ of the overall thickness 38 of the urinal screen 10. In some embodiments, the posts 22 space the frame 14 from the installation surface by at least ⅛, at least ⅐, at least ⅙, at least ⅕, at least ¼, at least ⅜, and/or by at least 4/9 of the overall thickness 38 of the urinal screen 10.

Spacing the frame 14 from the installation surface can reduce the likelihood that the openings 18 are clogged by debris. In some embodiments, the posts 22 positioned between the frame 14 and the installation surface can reduce splashing in the urinal by deflecting urine or other fluids which pass between the frame 14 and the installation surface (e.g., fluid that passes through the openings 18 or around the perimeter of the frame 14).

For expository purposes, the term "horizontal" as used herein is defined as a plane parallel to the plane or surface of the floor of the area in which the system being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

The terms "approximately", "about", "generally" and "substantially" as used herein represent an amount close to the stated amount that still performs a desired function or achieves a desired result. For example, the terms "approximately", "about", "generally," and "substantially" may refer to an amount that is within less than 10% of the stated amount.

While the preferred embodiments of the present inventions have been described above, it should be understood that they have been presented by way of example only, and not of limitation. It will be apparent to persons skilled in the relevant art that various changes in form and detail can be made therein without departing from the spirit and scope of the inventions. Thus the present inventions should not be limited by the above-described exemplary embodiments, but should be defined only in accordance with the following claims and their equivalents. Furthermore, while certain advantages of the inventions have been described herein, it is to be understood that not necessarily all such advantages may be achieved in accordance with any particular embodiment of the inventions. Thus, for example, those skilled in the art will recognize that the inventions may be embodied or carried out in a manner that achieves or optimizes one advantage or group of advantages as taught herein without necessarily achieving other advantages as may be taught or suggested herein.

What is claimed is:

1. A urinal screen comprising:

a frame comprising a plurality of perimeter structures;

a plurality of openings passing through the frame from a first side of the frame to a second side of the frame, each opening of the plurality of openings being defined by a perimeter structure of the plurality of perimeter structures that is at least partially shared with multiple other openings of the plurality of openings, wherein the plurality of openings are a majority of a total number of openings that pass through the frame from the first side of the frame to the second side of the frame;

a plurality of protrusions each extending away from at least one of the first side of the frame or the second side of the frame, wherein each protrusion of the plurality of protrusions is attached to a perimeter structure of the plurality of perimeter structures that is at least partially shared with multiple openings of the plurality of openings, wherein the plurality of protrusions are positioned such that:

at least some protrusions of the plurality of protrusions extend away from the first side of the frame and can deflect urine impacting the urinal screen from above the frame; and at least some protrusions of the plurality of protrusions extend away from the second side of the frame and can deflect urine impacting the urinal screen after having passed through the plurality of openings, wherein the plurality of protrusions are a majority of a total number of protrusions that extend away from at least one of the first side of the frame or the second side of the frame, and wherein the frame and the plurality of protrusions each comprise a fragranced plastic or EVA material.

2. The urinal screen of claim 1, wherein each opening of the plurality of openings is defined by a polygonal perimeter structure of the plurality of perimeter structures.

3. The urinal screen of claim 1, wherein each opening of the plurality of openings comprises a same shape.

4. The urinal screen of claim 1, wherein one or more openings of the plurality of openings comprises a different shape than one or more other openings of the plurality of openings.

5. The urinal screen of claim 1, wherein each protrusion of the plurality of protrusions comprises a same shape.

6. The urinal screen of claim 1, wherein one or more protrusions of the at least some protrusions that extend away from the first side of the frame comprises a different shape than one or more of the at least some protrusions that extend away from the second side of the frame.

7. The urinal screen of claim 1, wherein one or more protrusions of the at least some protrusions that extend away from the first side of the frame comprises a different height than one or more of the at least some protrusions that extend away from the second side of the frame.

8. The urinal screen of claim 1, wherein the plurality of protrusions comprises a plurality of posts.

9. The urinal screen of claim 1, wherein the plurality of protrusions comprises a plurality of structural supports.

10. A urinal screen comprising:

a frame;

a plurality of openings passing through the frame from a first side of the frame to a second side of the frame, each opening of the plurality of openings being defined by a polygonal perimeter structure that shares at least one side and at least one corner with another polygonal perimeter structure that defines another opening of the plurality of openings;

wherein the plurality of openings are a majority of a total number of openings that pass through the frame from the first side of the frame to the second side of the frame;

a plurality of posts or structural supports each extending away from at least one of the first side of the frame or the second side of the frame, wherein each post or structural support of the plurality of posts or structural supports is attached to a side or corner of a polygonal perimeter structure that defines an opening of the plurality of openings, wherein the plurality of posts or structural supports are positioned such that:

at least some posts or structural supports of the plurality of posts or structural supports extend away from the first side of the frame and can deflect urine impacting the urinal screen from above the frame; and at least some posts or structural supports of the plurality of posts or structural supports extend away from the second side of the frame and can deflect urine impacting the urinal screen after having passed through the plurality of openings, wherein the plurality of posts or structural supports are a majority of a total number of posts or structural supports that extend away from at least one of the first side of the frame or the second side of the frame, and wherein the frame and the plurality of posts or structural supports each comprise a fragranced plastic or EVA material.

11. The urinal screen of claim 10, wherein each opening of the plurality of openings comprises a same shape.

12. The urinal screen of claim 10, wherein one or more openings of the plurality of openings comprises a different shape than one or more other openings of the plurality of openings.

13. The urinal screen of claim 10, wherein each post or structural support of the plurality of posts or structural supports comprises a same shape.

14. The urinal screen of claim 10, wherein one or more posts or structural supports of the at least some posts or structural supports that extend away from the first side of the frame comprises a different shape than one or more of the at least some posts or structural supports that extend away from the second side of the frame.

15. The urinal screen of claim 10, wherein one or more posts or structural supports of the at least some posts or structural supports that extend away from the first side of the frame comprises a different height than one or more of the at least some posts or structural supports that extend away from the second side of the frame.

* * * * *